United States Patent [19]

Kendall

[11] Patent Number: 4,460,489

[45] Date of Patent: Jul. 17, 1984

[54] AEROSOL RUBBING COMPOUND

[75] Inventor: Stanley E. Kendall, Wilmette, Ill.

[73] Assignee: American Home Products Corporation, New York, N.Y.

[21] Appl. No.: 466,259

[22] Filed: Feb. 14, 1983

[51] Int. Cl.[3] ..... C11D 17/04

[52] U.S. Cl. ..... 252/90; 252/128; 252/131; 252/174; 252/DIG. 8; 51/308; 51/DIG. 20; 51/DIG. 21

[58] Field of Search ..... 252/90, 128, 131, 174; 51/308, DIG. 20, DIG. 21; 106/8

[56] References Cited

U.S. PATENT DOCUMENTS

| | | | |
|---|---|---|---|
| 2,090,708 | 8/1937 | Stahl | 252/90 |
| 3,650,956 | 3/1972 | Strand et al. | 51/308 |
| 4,122,161 | 10/1978 | Wason | 51/308 |
| 4,244,707 | 1/1981 | Wason | 51/308 |
| 4,279,766 | 7/1981 | Joubert et al. | 252/135 |

FOREIGN PATENT DOCUMENTS

| | | |
|---|---|---|
| 679056 | 1/1964 | Canada . |
| 1129636 | 10/1968 | United Kingdom . |

*Primary Examiner*—John E. Kittle
*Assistant Examiner*—Hoa Van Le
*Attorney, Agent, or Firm*—Joseph Martin Weigman

[57] ABSTRACT

A rubbing compound compound concentrate suitable for dispensing as a foam from an aerosol container is made from 16 to 28 percent by weight of a soap moiety which has a soap solids of 8 to 18 percent by weight of the soap moiety, from 16 to 46 percent by weight of an adjuvant moiety of suspending agents, wetting agents, lubricants and odoring agents and from 17 to 50 percent by weight of an abrasive, preferably amorphous silica, having a maximum particle size of 55 microns and sufficient deionized water to produce a viscosity of 60 to 80 Krebs units. An aerosol composition is made from the concentrate and 5 to 10 percent by weight of a propellent sufficent to provide aerosol discharge while maintaining an in-can solids of 45 to 60 percent by weight. The process of making the concentrate comprises first forming in place the soap moiety and serially adding the adjuvants and abrasive while maintaining a penetrometer reading of 350 to 450 mm. in ASTM D217.

6 Claims, No Drawings

AEROSOL RUBBING COMPOUND

This application relates to rubbing compounds for painted surfaces, and more particularly relates to rubbing compounds for automotive painted surfaces in which the rubbing compound is delivered in an aerosol spray foam.

The many rubbing compounds now on the market and intended for use on automobile finishes, and the like, are in relatively solid or heavy paste forms. Such rubbing compounds are used to remove oxidized or chalky pigments from existing, weathered finishes in order to restore color and gloss, to apply to refinished surfaces to eliminate "orange peel" and to rub-out overspray and to increase the gloss of the refinished area.

The known rubbing compounds are basically emulsions of water and organic solvents in combination with abrasives such as silica, magnesium silicate or the like. None of the rubbing compounds now on the market are in a convenient, easy-to-use aerosol form. There are no rubbing compounds in an aerosol "foam" spray known on the market. The abrasive materials used in manufacturing rubbing compounds necessarily have high specific gravities. Commonly used suspension aids that might provide pigment suspension needed for aerosol formulations would interfere with the intended function of the rubbing compound and also would leave an undesirable film on the painted surface.

The use of soap fatty acids in abrasive cleaners is described in U.S. Pat. 3,619,962, issued Nov. 16, 1971. In that patent, the soap fatty acid is present in a form of salt with a weak base, which is also present as part of the formulation. The soap fatty acid salt of that patent is primarily present for its detergent properties, and it is believed to wash away loosened tarnish particles from the surface of the metallic substrate that is being cleaned. At the same time, it is believed to aid in the formation of a non-corrosive surface film which is left by the cleaning composition on the surface of the metallic substrate. The patent, however, is distinguishable from the present invention by the requirements of the other ingredients to achieve its purpose. The other ingredients include a combination of calcined and uncalcined diatomaceous silica, a lower aliphatic dicarboxylic acid, a weak base and a gelling agent. None of the latter are required for the practice of the present invention.

It is an object of the present invention to provide a unique combination of ingredients, together with innovative manufacturing techniques to make possible the commercial production and marketing of an effective and convenient aerosol rubbing compound product.

In addition, it is an object of the present invention to provide an aerosol foam spray formulation that will be stable in an aerosol can, free from "hard settling" and the like.

It is a further object of the present invention to provide a method of making such formulations.

The objects of this invention may be achieved with formulations that combine a critical concentration of soap solids which, together with other ingredients in the formulation, provides for effective suspension of the abrasives and, by controlling viscosity based on penetrometer readings during the manufacturing process, cause an increase in "body" of the product prior to the addition of the abrasive.

The objects of this invention may be achieved with formulations comprised of a soap moiety, an abrasive and an adjuvant moiety with sufficient excess (or final) water to control viscosity. There is no single suspension aid or ingredient in the formula. Pigment suspension is effected by a stable emulsion and the proper selection and amounts of abrasive pigments and adjuvants.

More particularly, the objects of the invention may be achieved with a composition which consists of an abrasive, a homogeneous oil-in-water emulsion which acts as a carrier for the abrasive, and an adjuvant moiety. The preferred composition of the present invention is made by mixing together sodium hydroxide and oleic acid in deionized water to form the emulsion. The sodium hydroxide and oleic acid react to form a soap which then forms an emulsion with the deionized water. The emulsion acts as a carrier for the other ingredients as well as giving body to the formulation and also prevents hard settling in the can. Other unsaturated fatty acids may be substituted for oleic acid, such as linoleic and linolenic acid. A high pH greater than 8 is needed for can stability, preferably 8–11. This is provided by excess sodium hydroxide.

The Soap Moiety

The best-known of the anionic-active emulsifying agents are the soaps. Soaps are the salts of the long-chain fatty acids, which are themselves derived from naturally occurring fats and oils, in which the fatty acids are present as the triglyceride. The soaps used in emulsification procedures may be obtained directly from the natural oil, in which case they will consist of a mixture of various fatty acids. Preferably, the soap of oleic ($C_{17}H_{33}COOH$) acid is used. In addition, linoleic ($C_{17}H_{31}COOH$), and ricinoleic ($C_{17}H_{32}OHCOOH$) acids may be used. These are obtainable in a fairly high state of purity from natural sources.

For the preparation of oil-in-water emulsions, an alkaline hydroxide is reacted in place with the fatty acids. The sodium soaps of these fatty acids preferably are used; but potassium soaps may be used. The sodium soaps, in solution, are distinctly alkaline, with a pH in the neighborhood of 10. As a result, they are particularly effective in emulsions of this invention where this relatively high degree of alkalinity is desirable.

Some amine soaps may also be used as emulsifying agents. These materials are advantageous when a lower pH (about 8.0) is desirable. The amine soaps are the salts of the various substituted ammonium ions derived from the substituted amines of the general formula: $NR_3$ where R may be hydrogen or various organic groupings, for example, triethanolamine. The soaps of the multivalent metals (calcium, zinc, aluminum, etc.) may be used in the present invention because they favor the formation of oil-in-water emulsions, but they are somewhat inefficient emulsifiers by themselves and are usually used in conjunction with other agents, in order to take advantage of the high emulsion viscosity which they impart. Cyclic amines may also be employed, such as morpholine. The more structurally complex amines may also be employed, for example, 2-amino-2-methyl-1,3-propanediol and 2-amino-2-methyl-1-propanol (AMP). All of these amino-compounds form substituted ammonium salts of the fatty acids, for example, triethanolammonium oleate. The amine salts are formed in situ by the direct reaction of the appropriate amounts of amine and fatty acid. The alkali and amine soaps function as stabilizers for oil-in-water emulsions, and they have the advantage of being relatively inexpensive as well as quite effective.

Because it is desired to use soaps as emulsifying agents, it is necessary to use soft water, or to soften the water by distillation or demineralization, or by the addition of softening agents such as the complex phosphates or the derivatives of ethylenediamine-tetra-acetic acid ("V ersene").

Potassium soaps are white, soft, and soluble and are highly effective emulsifiers and detergents. Triethanolamine soaps, with reduced alkalinity, have the useful property of being oil-soluble and are thus even more effective as coupling and emulsifying agents. They tend to discolor on standing, however. Ammonium soaps also show some tendency to discolor, but are otherwise quite similar to potassium soaps.

Adjuvant Moiety

It has been found advantageous to include in the composition auxiliary ingredients which enhance the manufacturing process, the suspension of the abrasive, the cleaning properties of the product and its appearance. The adjuvant moiety includes compounds which have multiple functions as lubricants, suspending agents, wetting agents, solvents and perfumes or odoring agents.

The preferred adjuvants are industrial glycerine, mineral seal oil, kerosene, pine oil and lecithin. Others include mineral spirits, industrial perfumes, silicone fluids, synthetic and natural waxes, and the like.

Abrasive Moiety

The preferred abrasive is amorphous silica. The 200 mesh (Tyler) size is the preferred size. No hard settlement occurs with that size. Larger particle sizes tend to hard settle. Also, larger particle sizes cause problems with an aerosol foam valve which preferably has a maximum size of 0.020 inches. Moreover, coarser particles may scratch the finish.

Two marketably distinct products may be made depending on particle size: a rubbing compound and a finish restorer. The latter has less pigment (abrasive) and finer abrasive than the former. Increasing the grit size makes the product "stronger" in that it has more power to remove paint. The finish restorer grit size is 99.9% through 400 mesh. The rubbing compound has 96–98% through 325 mesh.

Most rubbing compounds use relatively larger size particles because the larger the particles, the more the abrasion. It has been found that for an aerosol dispensed rubbing compound the particle size may not exceed 55 microns. This is limited by the orifice size of the dispensing container.

It was found that while 55 microns is 0.0022 inches and the aerosol valve exit hole is 0.020 inches, pigment particles tend to agglomerate and are held together by electrical forces which are difficult to break resulting in particle sizes too large to exit. Pigment particle sizes above 55 microns are usually not functional. In addition pigment manufacturers give particle size ranges and there are always extremes-a few particles are on the very high side of the range and a few oversized particles can plug an orifice.

The Manufacturing Process

Early attempts to make the compositions of the present invention were unsuccessful. Trace elements present in the city water supply were found to cause the emulsion to break resulting in a heterogeneous, rubbery, stringy product. In order to make the compositions, it was found necessary to use deionized water.

Also, it was found necessary to form the emulsion before the solvents are added. The preferred emulsion is formed with the deionized water, sodium hydroxide and oleic acid. It was discovered that in the preferred emulsion the weight ratio of sodium hydroxide to oleic acid must be 0.337 to 2.940 or 1 to 8.72.

Once the emulsion is formed it has been found advantageous to add an adjuvant compound which will help to retain the water in the emulsion. Industrial glycerine is the preferred compound for this purpose.

In the initial step the soap solids level is critical. It has been found advantageous to add only a portion of the water initially when forming the emulsion. The balance is added after the penetrometer test for body. Additional adjuvants are added, if necessary, to adjust the penetrometer reading to 350 to 450 mm. in standard test ASTM D217.

In paint terminology, anything that does not evaporate in a composition contributes to the solids. On that basis the total solids portions of the preferred embodiment of the composition include the reaction product of sodium hydroxide and oleic acid, and mineral seal oil in addition to the amorphous silica. The soap solids are the solids in the reaction product of the sodium hydroxide and oleic acid. The soap solids cannot exceed 18 percent by weight of the sodium hydroxide, oleic acid and water in the initial mix when the soap is formed, and should be in the 8–18 percent range, preferably 12–17 percent. Solids above 18% at this stage will cause high viscosity, gelling, and hard settling mainly due to an emulsion 'break'.

After the blend and reaction of the first three ingredients, the remaining ingredients are added one at a time and each is blended into the mix before another one is added.

Next is added a lubricant which serves to make the abrasive slide more easily during the process of rubbing the finish. The lubricant makes the composition slipperier. In the preferred embodiment mineral seal oil is used.

Next are added additional solvents one at a time. Solvents preferably have a high flash point and do not attack the painted finish on which the product is intended for use. The solvents add fluidity to the composition. Kerosene is a preferred solvent because in addition it serves as a cleaner for the surface that is being rubbed. Pine oil is another preferred solvent and serves in addition to provide a pleasant aroma to the composition.

A wetting agent may be used to wet down the abrasive and make it easier to disperse in the emulsion. Lecithin is the preferred wetting agent. The level of soap formed is critical to the addition of lecithin and must not exceed 18%. It is believed the lecithin may react with sodium hydroxide and cause poor results if the soap forming compounds are in excess.

The abrasive is added last and is the gritty ingredient which will be the effective rubbing agent itself. A morphous silica is preferred for this purpose and is used in the range of 17 to 50 percent by weight.

As the final step, sufficient additional deionized water is added to provide a viscosity at 25° C. of 60 to 80 Krebs units (Stomer) as determined on a Krebs-Stomer viscosimeter following the procedure of ASTM D562.

The Propellant

The product is unusual in that water is used in an aerosol dispensed product. The preferred propellent is fifty percent propane and fifty percent isobutane (A-70). The propellent comprises about 5 to 10 percent by weight of the final product, preferably 6 to 9 percent. The in-can solids are much higher in the present compositions than other aerosol products. The amount of propellent is sufficient to provide aerosol discharge while maintaining high in-can solids. This is about 5 to 10 percent by weight of the total aerosol composition, preferably 6 to 8 percent by weight. Most aerosol paints have in-can solids of 10 to 20 percent by weight. The present compositions have in-can solids of 45 to 60 percent by weight of the total composition, preferably 49 to 59. Most conventional rubbing compounds sold as pastes in metal tins have solids of 60–70% by weight.

The propellents are not soluble in the water and take a long time to work into the solvent. It was found advantageous to shake the can during filling.

In the preferred embodiment, the product of the present invention is delivered as a foam. This enables the user to spray the compound where wanted and have the foam stick to the surface without running. The foam also provides better rubbing properties.

Either a foam valve or conventional paint valve may be used. A foam valve delivers a drier foam. The foam may be sprayed directly onto the surface, but preferably is sprayed into a cloth and applied manually.

The foam produced in spraying depends in part on the use of a suitable aerosol foam valve. The following valves have been found to give excellent results in a 211×413 12 ounce aerosol can.

| | | |
|---|---|---|
| A. | VALVE TYPE: | Seaquist NS-21 |
| | STEM ORIFICE: | 2 × .020 Acetal, length 333 mm blue |
| | GASKET: | Buna N .039" |
| | CUP: | Regular, plain, dimpled |
| | SPRING: | .023" 302 SS |
| | SEAT: | None |
| | BODY: | .062" Barbed, Nylon, Green |
| | VAPOR TAP: | None |
| | TUBING ID: | .165" Wall .023" |
| | DIPTUBE: | A-D Dim. 5 3/16" |
| | CAN SIZE: | 12 ounce = 211 × 413 |
| B. | Valve = | Seaquist SF81 0 Valve Assembly |
| | | Buna 0.128" Gasket |
| | | Stainless Steel Spring |
| | | No Vapor Tap Hole |
| | | Uncoated Valve Cup |
| | | STD Tubing 5 3/16" A-D Dim |
| | Spray Tip = | SF81 Type |
| | | #803-27-45 One Piece Block |
| | | Stem Slot = 0.027" |
| | | Exit Orifice = 0.045" |

While most ingredients can be increased or decreased 5%, the ratio of sodium hydroxide to oleic acid must remain fairly constant. The higher the viscosity of the product, the greater the anti-settling and less of a tendency for the product to run on the surface. Changing the amount of water changes these porperties and changes the foam pattern. The following formula is the preferred embodiment having the optimum properties which can be changed within limits and still maintain a useful product.

The general formula for the concentrate is

| | Wt. % in concentrate | |
|---|---|---|
| | Maximum Range | Preferred Range |
| Soap Moiety | 16–28 | 16.6–17.7 |
| Deionized water to form emulsion | 14–23 | 14.1–14.8 |
| Hydroxyl & Hydroxide Donor | 0.3–1.3 | 0.33–0.34 |
| Unsaturated Fatty Acids | 2–3 | 2.2–2.5 |
| Adjuvant Moiety | 16–46 | 16–20 |
| Glycerine | 1–9 | 1–2 |
| Mineral Seal Oil | 3–6 | 4–5 |
| Kerosene | 10–13 | 10–11 |
| Pine Oil | 1–9 | 1–2 |
| Lecithin | 1–9 | 1–2 |
| Abrasive Moiety | | |
| Amorphous Silica | 17–50 | 41–46 |
| Final Water | 12–42 | 18–22 |
| Soap Solids | 8–18 | 12–17 |
| In-Can Solids | 45–60 | 49–59 |

For aerosol dispensing, the concentrate prepared above was mixed with a propellent according to the following formula:

| PROPELLENT | |
|---|---|
| Concentrate | 294 Grams |
| Propellent | 21 Grams |
| Total | 315 Grams |

The above aerosol fill uses A-70 propellent, consisting of liquid or liquefied petroleum gases (LPG).

Following is an aerosol fill for the product using a different propellent DME or dimethyl ether also called dimethyl oxide:

| | |
|---|---|
| Concentrate | 294 Grams |
| D.M.E. | 26 Grams |
| Total | 320 Grams |

In order more clearly to disclose the nature of the present invention, specific examples of the practice of the invention are hereinafter given. It should be understood, however, that this is done solely by way of example and is intended neither to delineate the scope of the invention, nor limit the ambit of the appended claims. In the examples, the following abbreviations are used: "Wt. %" means percent by weight of the total concentrate formulation. Soap solids are stated in percent by weight of the emulsion or soap moiety. "CAS No." is the identification of the ingredient in accordance with the Toxic Substances Control Act.

EXAMPLE 1

This example illustrates the manufacture of a finish restoring compound, suitable for dispensing from an aerosol container, by controlling at critical points in the process the viscosity of the intermediate products as indicated by the penetrometer readings.

Concentrate

The ingredients are loaded into a tank in the precise following order, one item at a time, and mixed until smooth before adding the next ingredient:

| | Pounds | % Wt. | CAS. No. |
|---|---|---|---|
| Deionized Water | 158.85 | 14.8 | 7732-18-5 |
| Sodium Hydroxide | 3.65 | 0.3 | 1310-73-2 |

-continued

| | Pounds | % Wt. | CAS. No. |
|---|---|---|---|
| When dissolved add: | | | |
| Oleic Acid | 24.00 | 2.2 | 112-80-1 |

The foregoing has soap solids of 14.83 wt. %

Mix ten minutes, then add the following one at a time and mix each five minutes.

| | | | |
|---|---|---|---|
| Industrial Glycerine | 15.75 | 1.5 | 56-81-5 |
| Mineral Seal Oil | 47.11 | 4.4 | 8012-95-1 |
| Kerosene | 111.72 | 10.4 | 8008-20-6 |
| Pine Oil | 18.80 | 1.8 | 8002-09-3 |

The foregoing ingredients are mixed for 20 minutes and then is added slowly under agitation:

| | | | |
|---|---|---|---|
| Amorphous Silica | 456.29 | 42.5 | 60676-86-0 |

A penetrometer reading is then made. The penetration test measures the depth to which a cone with a known top load penetrates a sample. The penetrometer may be of the universal rack and pinion type such as the Sargent-Welch S2235 (RC-10) and is used in standard test ASTM D217. The penetrometer reading must be in the range 350–450 mm. with grease cone attachment.

| | | | |
|---|---|---|---|
| Add slowly while mixing: | | | |
| Deionized water | 237.33 | 22.1 | 7732-18-5 |
| | 1073.50 | 100.00 | |

The product weighs 10.81 lb/gallon and has a solids content of 53.51 Wt. % and a viscosity at 25° C. of 60-80 Krebs units (Stomer). The viscosity may be determined on a Krebs-Stomer viscosimeter following procedure ASTM D562.

The product was charged into an aerosol container at the rate of 294 grams of concentrate to 21 grams of A70 propellent. The product showed good spraying qualities and good rubbing qualities. The solids content of the aerosol is 49.95 weight percent.

EXAMPLE 2

The following example demonstrates criticality of the solids content of the soap moiety.

Following the procedure of Example 1, concentrates were made with the following ingredients where the amounts are stated in pounds and charged into an aerosol dispenser.

| | A | | B | | C | | D | |
|---|---|---|---|---|---|---|---|---|
| | Amt. | Wt. % | Amt. | Wt. % | Amt. | Wt. % | Amt. | Wt. % |
| Soap Moiety | | | | | | | | |
| Deionized Water | 551.3 | 15.52 | 522. | 14.80 | 509.4 | 14.20 | 386.9 | 11.17 |
| Sodium Hydroxide | 9.7 | 0.27 | 11.9 | 0.33 | 11.9 | 0.33 | 11.9 | 0.34 |
| Oleic Acid | 64.5 | 1.81 | 78.3 | 2.22 | 101.2 | 2.82 | 101.2 | 2.92 |
| Adjuvant Moiety | | | | | | | | |
| Glycerine | 51. | 1.43 | 51 | 1.44 | 50.8 | 1.41 | 50.8 | 1.46 |
| Mineral Seal Oil | 152. | 4.28 | 155 | 4.39 | 152. | 4.23 | 152. | 4.38 |
| Kerosene | 360. | 10.14 | 367 | 10.41 | 360. | 10.04 | 360. | 10.39 |
| Pine Oil | 60 | 1.69 | 60 | 1.70 | 60 | 1.67 | 60. | 1.73 |
| Abrasive Moiety | | | | | | | | |
| Amorphous Silica | 1612 | 45.40 | 1500 | 42.55 | 1612 | 44.96 | 1612 | 46.54 |
| Red Iron Oxide | 32 | 0.90 | | | 32 | 0.89 | 32 | 0.92 |
| Final Water | 657 | 18.50 | 780 | 22.12 | 696 | 19.41 | 696 | 20.09 |
| Total | 3550 | | 3525 | | 3585 | | 3463 | |
| Soap Solids wt. % | 11.9 | | 14.7 | | 18.2 | | 22.6 | |
| KU Viscosity | 59. | | 62 | | — | | mud | |

Product A was workable but thin, that is, had low viscosity.

Product B was an excellent product and had 14.7 soap solids.

Product C was a borderline product not of elegant quality and shows 18% soap solids to be maximum of range.

Product D contained 22.6 wt. % soap solids and was too heavy and was not a useful product.

EXAMPLE 3

The following example illustrates the preparation of a red rubbing compound.

Following the procedure of Example 1, red rubbing compound concentrate was made with the following ingredients.

| | Pounds | % Wt. |
|---|---|---|
| Soap Moiety | | |
| Deionized Water | 253. | 22.81 |
| Sodium Hydroxide | 3.7 | .33 |
| Oleic Acid | 24.0 | 2.16 |
| Adjuvant Moiety | | |
| Glycerine | 15.75 | 1.42 |
| Mineral Seal Oil | 47.11 | 4.24 |
| Kerosene | 111.6 | 10.06 |
| Pine Oil | 18.6 | 1.67 |
| Abrasive Moiety | | |
| Amorphous Silica | 500. | 45.08 |
| Red Iron Oxide | 10. | 0.90 |
| Final Water | 220.25 | 19.83 |
| Total | 1109.01 | |

The product contained 14.92 wt. % soap solids and was charged into an aerosol dispenser with shaking. The product gave excellent results in use.

EXAMPLE 4

The following example illustrates the formulation difference in preparing a color restorer and a rubbing compound and illustrates the necessity for shaking the containers during propellent addition.

Following the procedure of Example 1, concentrates were prepared having the following formulations.

| | Color Restorer (pounds) | Wt. % | Rubbing Compound (pounds) | Wt. % |
|---|---|---|---|---|
| Soap Moiety | | | | |
| Deionized Water | 158.85 | 14.79 | 158.0 | 14.24 |
| Sodium Hydroxide | 3.65 | 0.33 | 3.7 | 0.33 |
| Oleic Acid | 24.00 | 2.23 | 24.0 | 2.16 |
| Adjuvant Moiety | | | | |
| Glycerine | 15.75 | 1.46 | 15.75 | 1.42 |
| Mineral Seal Oil | 47.11 | 4.38 | 47.11 | 4.24 |
| Kerosene | 111.72 | 10.40 | 111.60 | 10.06 |
| Pine Oil | 18.88 | 1.75 | 18.60 | 1.67 |
| Abrasive Moiety | | | | |
| Fine Silica (1) | 456.29 | 42.50 | | |
| Coarse Silica (2) | — | | 500 | 45.08 |
| Red Iron Oxide | — | | 10 | 0.09 |
| Final Water | 237.33 | 22.10 | 220.25 | 19.83 |
| Total | 1073.58 | | 1109.01 | |
| Solids (concentrate) | 53.51% wt. | | 62.32 wt. % | |
| In-Can Solids (aerosol) | 49.95% wt. | | 58.2 wt. % | |
| Weight | 10.81 pounds/gal | | 11.20 pounds/gal | |

The concentrate was charged into an aerosol container in the amount of 294 grams of concentrate and 21 grams of propellant A-70 while shaking.

Due to the high viscosity of the product and the fact that the propellent is not soluble in water, the aerosol cans must be shaken to disperse the propellent throughout the product. The pressure of the propellent is lowered when it comes into contact with the hydrocarbon solvents in the emulsion. Until this dissolving of the propellent in the solvents it exerts a pressure high enough to rupture or distort the aerosol can when the can reaches water bath temperature. The temperature of the water bath is 145° F.

EXAMPLE 5

The following example illustrates the preparation of an aerosol-dispensible rubbing compound concentrate having large particle size abrasive.

Following the procedure of Example 1, a product was prepared from the following formulation.

| | grams | Wt. % |
|---|---|---|
| Soap Moiety | | |
| Deionized Water | 614 | 14.84 |
| Sodium Hydroxide | 14 | 0.33 |
| Oleic Acid | 123 | 2.97 |
| Adjuvant Moiety | | |
| Glycerine | 61 | 1.47 |
| Mineral Seal Oil | 182 | 4.39 |
| Kerosene | 432 | 10.44 |
| Pine Oil | 73 | 1.76 |
| Interface Modifier (R & R 551) | 18 | 0.43 |
| Abrasive Moiety | | |
| Red Iron Oxide | 30 | 0.72 |
| #200 Silica (a) | 1700 | 41.09 |
| Final Water | 910 | 21.99 |
| | 4137 | |

A 140 gram portion of the above concentrate and 10 grams of A-70 propellent were charged into a container having a foam valve with a 0.020 inch orifice (Seaquist type NS-21).

(a)-#200 silica (SR ILL Mineral Co.) is air floated amorphous silica with 90–95% passing through a 200 mesh (Tyler) screen and 75–79% passing through a 325 mesh screen and weighs 32–34 pounds per cubic foot. The 300 mesh screen has 55 micron openings. The 200 mesh screen has 74 micron openings.

Samples of this formulation were placed in out Hot-Box at 135° F. for a period of time and checked for sprayability. Some of the particles reagglomerated and plugged the exit orifice of the aerosol valve. This pigment has a high percentage of particles over 55 microns, which is our upper limit for particle size. This confirms the upper limit of our particle size range.

R&R 551 is an interface modifier available from Ross & Rowe, Inc., a subsidiary of Archer Daniels Midband Company, Decatur, Ill. The composition is a water dispersible, all organic, nonionic surfactant and protective colloid used in latex and resin emulsion paints. Its protective colloid action increases the effectiveness of stabilizers and thickeners resulting in products with long-lasting, smooth, creamy consistency and maximum freeze-thaw stability. It promotes fast pigment wetting and aids in rapid and thorough blending of ingredients and prevents separation, settling and flocculation during storage.

EXAMPLE 6

The following example illustrates the preparation of an aerosol-dispensible rubbing compound using linoleic acid in place of oleic acid.

Following the procedure of Example 1, a concentrate was prepared from the following formulation.

| | grams | Wt. % |
|---|---|---|
| Soap Moiety | | |
| Deionized Water | 540 | 14.15 |
| Sodium Hydroxide | 13 | 0.34 |
| Linoleic Acid | 96 | 2.15 |
| Adjuvant Moiety | | |
| Glycerine | 54 | 1.41 |
| Mineral Seal Oil | 161 | 4.21 |
| Kerosene | 382 | 10.01 |
| Pine Oil | 64 | 1.67 |
| Abrasive Moiety | | |
| Amorphous Silica | 1715 | 44.94 |
| Red Iron Oxide | 35 | 0.91 |
| Final Water | 755 | 19.79 |
| Total Weight | 3815 | |

The soap solids content was 16.80 percent by weight. The penetrometer reading was 280 millimeters.

The above concentrate was filled into aerosol containers as in Example 1 and showed good spraying qualities.

EXAMPLE 7

The following example illustrates the preparation of an aerosol-dispensible rubbing compound using different grades of oleic acid.

Following the procedure of Example 1, a concentrate was prepared from the following formulations.

| | A grams | Wt. % | B grams | Wt. % |
|---|---|---|---|---|
| Soap Moiety | | | | |
| Deionized Water | 540 | 14.15 | 540 | 14.15 |
| Sodium Hydroxide | 13 | 0.34 | 13 | 0.34 |
| Oleic Acid (Emersol 213) | 96 | 2.51 | | |
| Oleic Acid (Emersol 221) | | | 96 | 2.51 |
| Adjuvant Moiety | | | | |
| Glycerine | 54 | 1.41 | 54 | 1.41 |
| Mineral Seal Oil | 161 | 4.21 | 161 | 4.21 |
| Kerosene | 382 | 10.01 | 382 | 10.01 |

-continued

| | A grams | Wt. % | B grams | Wt. % |
|---|---|---|---|---|
| Pine Oil | 64 | 1.67 | 64 | 1.67 |
| Abrasive Moiety | | | | |
| Silica 3118 | 1715 | 44.94 | 1715 | 44.94 |
| Red Iron Oxide-Blue Shade | 35 | 0.91 | | |
| Red Iron Oxide-Yellow Shade | | | 35 | 0.91 |
| Final Water | 755 | 19.79 | 755 | 19.79 |
| Total Weight | 3815 | | 3815 | |
| Soap Solids | 16.8 wt. % | | 16.8 wt. % | |

The concentrate was charged into an aerosol container as in Example 1 and showed good spraying qualities and rubbing qualities.

Silica 3118 is Illinois Mineral Co. number 1160 and is an air floated grade of silica 99.98 percent passing through a 200 mesh (Tyler) screen, 96–98 percent passing through 325 mesh and 92.65 passing through 400 mesh with 92 percent particles below 40 microns diameter.

Other than color, there are no differences between the two formulations.

Emersol 213 and 221 are available from Emery Industries, Inc. Both have acid values of 199–204 and saponification values of 201–206. Emersol 213 has a color transmission of 50/86 (%, 440/1550 nm., min.). Emersol 221 has a color transmission of 71/99. Thus, Emersol 213 is slightly more yellow than Emersol 221, but otherwise they are equivalent.

EXAMPLE 8

The following example illustrates the preparation of an aerosol-dispensible rubbing compound using aminohydroxy compounds to form the soap moiety.

Following the procedure of Example 1, a concentrate was prepared from the following formulation.

| | A gram | Wt. % | B gram | Wt. % |
|---|---|---|---|---|
| Soap Moiety | | | | |
| Deionized Water | 540 | 14.13 | 700 | 18.83 |
| 2-amino-2-methyl-1,3-propanediol | 16 | 0.41 | — | — |
| Triethanolamine | — | | 45 | 1.21 |
| Oleic Acid | 96 | 2.51 | 80 | 2.15 |
| Adjuvant Moiety | | | | |
| Glycerine | 54 | 1.41 | 50 | 1.34 |
| Mineral Seal Oil | 161 | 4.21 | 160 | 4.30 |
| Kerosene | 382 | 10.00 | 380 | 10.22 |
| Pine Oil | 64 | 1.67 | 51 | 1.37 |
| Abrasive Moiety | | | | |
| Silica 3118 | 1715 | 44.90 | 1715 | 46.15 |
| Red Iron Oxide | 35 | 0.91 | 35 | 0.94 |
| Final Water | 755 | 19.24 | 500 | 13.45 |
| Total Weight | 3818 | | 3716 | |
| Soap Solids wt. % | 17.18 | | 15.15 | |
| KU Viscosity | 70 | | 66 | |

Both concentrates were charged into an aerosol container as in Example 1 and showed good spraying qualities and rubbing qualities.

EXAMPLE 9

The following example illustrates the preparation of an aerosol-dispensible rubbing compound using potassium hydroxide to form a soap moiety.

Following the procedure of Example 1, a concentrate was prepared from the following formulation.

| | grams | Wt. % |
|---|---|---|
| Soap Moiety | | |
| Deionized Water | 560 | 14.66 |
| Potassium Hydroxide | 18 | 0.47 |
| Oleic Acid | 96 | 2.51 |
| Adjuvant Moiety | | |
| Glycerine | 54 | 1.41 |
| Mineral Seal Oil | 161 | 4.21 |
| Kerosene | 382 | 10.00 |
| Pine Oil | 64 | 1.67 |
| Abrasive Moiety | | |
| Silica 3118 | 1715 | 44.90 |
| Red Iron Oxide | 35 | 0.91 |
| Final water | 735 | 19.24 |
| Total Weight | 3820 | |
| Soap Solids wt. % | 15.15 | |
| KU Viscosity | 64 | |

The concentrate was charged into an aerosol container as in Example 1 and showed good spraying qualities and rubbing qualities.

What is claimed is:

1. A pressurized rubbing compound in an aerosol container and suitable for dispensing therefrom comprising:

A. from 16.6 to 22.19 percent by weight of a soap moiety having from 12 to 17 percent soap solids based on the weight of the soap moiety and formed from a first member selected from the class consisting of sodium hydroxide, potassium hydroxide, triethanolamine and 2-amino-2-methyl-1,3-propanediol and a second member selected from the class consisting of oleic acid and linoleic acid in the ratio of 1 to 8.72;

B. from 41 to 46 percent by weight of amorphous silica having a maximum particle size of 55 microns;

C. from 16 to 20 percent by weight of an adjuvant moiety further comprising:

i. an amount of glycerine sufficient to retain water in the emulsion formed by said soap moiety;

ii. a lubricant in an amount sufficient to make the silica slide more easily during use; and iii. a solvent in an amount sufficient to add fluidity to the composition, D. from 18 to 22 percent by weight of deionized water to produce a viscosity of 60 to 80 Krebs units; and E. sufficient propellent to provide aerosol discharge.

2. A pressurized rubbing compound in an aerosol container and suitable for dispensing therefrom comprising:

A. from 16.6 to 17.7 percent by weight of a soap moiety having from 12 to 17 percent soap solids based on the weight of the soap moiety and formed from sodium hydroxide and oleic acid in the ratio of 1 to 8.72;

B. from 16 to 20 percent by weight of an adjuvant moiety further comprising:

i. an amount of glycerine sufficient to retain water in the emulsion formed by said soap moiety;

ii. a lubricant in an amount sufficient to make the abrasive silica slide more easily during use; and iii. a solvent in an amount sufficient to add fluidity to the composition;

C. from 41 to 46 percent by weight of amorphous silica having a maximum particle size of 55 microns;

D. from 18 to 22 percent by weight of deionized water to produce a viscosity of 60 to 80 Krebs units; and E. sufficient propellent to provide aerosol discharge.

3. A pressurized rubbing compound as defined in claim 1 wherein said soap moiety second member is linoleic acid.

4. A pressurized rubbing compound as defined in claim 1 wherein said soap moiety first member is potassium hydroxide.

5. A pressurized rubbing compound as defined in claim 1 wherein said soap moiety first member is 2-amino-2-methyl-1,3-propanediol.

6. A pressurized rubbing compound as defined in claim 1 wherein soap moiety first member is triethanolamine.

* * * * *